US006149340A

United States Patent [19]

Pateman

[11] Patent Number: 6,149,340

[45] Date of Patent: Nov. 21, 2000

[54] SELF-RIGHTING STREET SIGN

[76] Inventor: Thomas J. Pateman, 416-3rd St. West, Cochrane, Alberta, Canada, T0L 0W1

[21] Appl. No.: 09/276,951

[22] Filed: Mar. 26, 1999

[30] Foreign Application Priority Data

Mar. 26, 1998 [CA] Canada ..... 2233379

[51] Int. Cl.[7] ..... E01F 9/017

[52] U.S. Cl. ..... 404/10; 404/11; 40/608

[58] Field of Search ..... 404/10, 11; 116/63 R; 40/608, 612; 52/113; 248/160

[56] References Cited

U.S. PATENT DOCUMENTS

| | | | |
|---|---|---|---|
| 1,679,623 | 8/1928 | Olsen . | |
| 3,193,230 | 7/1965 | Crankshaw . | |
| 3,838,661 | 10/1974 | Medley, Jr. | 116/63 |
| 4,106,879 | 8/1978 | Diedershagen et al. | 404/10 |
| 4,270,873 | 6/1981 | Laehy et al. | 404/10 |
| 4,565,466 | 1/1986 | Daggs et al. | 404/10 |
| 4,724,279 | 2/1988 | Ayscue | 174/38 |
| 4,729,690 | 3/1988 | Lavender et al. | 404/10 |
| 4,806,046 | 2/1989 | Clark | 404/10 |
| 4,951,407 | 8/1990 | Werner | 40/608 |
| 5,160,111 | 11/1992 | Hugron | 248/548 |
| 5,199,814 | 4/1993 | Clark et al. | 404/10 |
| 5,354,144 | 10/1994 | Lizakowski | 404/10 |
| 5,397,197 | 3/1995 | Beavers | 404/10 |
| 5,703,577 | 12/1997 | Carter | 340/908 |

FOREIGN PATENT DOCUMENTS

| | | | |
|---|---|---|---|
| 658267 | 2/1963 | Canada | 39/67 |
| 1085574 | 9/1980 | Canada | 20/108.1 |
| 2202564 | 9/1988 | United Kingdom . | |

*Primary Examiner*—James A. Lisehora
*Attorney, Agent, or Firm*—Sheridan Ross P.C.

[57] ABSTRACT

Apparatus is provided for self-righting a signpost after it has been tipped over comprising a plate for connecting to the signpost and a complementary tray secured to the ground. Most of the apparatus is located below ground out of harm's way. The tray has upturned peripheral edges within which the plate resides. A chain is connected to the plate, extends through a hole in the tray and into the bore of a pipe for connecting to the bottom of a compression spring. When the signpost and plate tip, the plate rotates within the tray, displacing the chain and compressing the spring. Preferably a lip extending over the edge of the plate causes the plate to ride up the edge of the tray, increasing the chain's displacement. The increased tension in the chain urges the plate and signpost to right themselves. The plate and tray are complementary and square shape so that the square sides engage during tipping and prevent rotation of the signpost's orientation when it returns to the upright position. Preferably a cup is mounted to the plate for insertion of the shaft of a conventional signpost.

7 Claims, 4 Drawing Sheets

4
STOP
STOP 28
2
5
7
2
3
15
1
1
3
28

6
7

SELF-RIGHTING STREET SIGN

FIELD OF THE INVENTION

The invention relates generally to spring-loaded devices for automatically righting a sign which has been knocked over, and more particularly, for enabling the sign to maintain its original orientation.

BACKGROUND OF THE INVENTION

Road signposts are subject to being struck by a vehicle and as a result be broken off at the base of the signpost. At higher speeds, or for signs having large upper mass, there is little opportunity to prevent breakage, plastic deformation or other loss of the sign. Solid signposts break off regardless of the speed of impact. However, at lower vehicle/sign impact speeds it is desirable to have a sign post which gives way and then springs back. Municipalities spend significant money and personnel resources to repair the many broken road signs.

In one approach to this problem, municipalities have generally provided a small base plate secured to the ground and having with a cup and transverse post-pinch bolt. A crew typically cuts off the broken bottom of the typically metal post and reinserts the cut end back into the cup, the repaired sign being slightly shorter but often not too badly damaged. While the material cost is low, the need for the attendance of maintenance personnel causes the cost to be high.

It is known to provide spring-loaded signpost bases to reduce the incidence of sign damage and obviate the need for a repair crew to attend at every impact occurrence. Many of these prior art bases utilize extension tension springs which are subject to breakage, particularly at the hooked ends. Example of such devices using an extension spring are U.S. Pat. Nos. 4,106,879 and 4,270,873 issued to Diedershagen and Laehy et al. respectively. These devices and others like U.S. Pat. No. 5,703,577 to Carter use above-ground components which are very exposed and subject to post-impact damage by the offending vehicle. Others do not automatically center on their base and return to a standing position such as in U.S. Pat. No. 3,838,661 issued to Hedley, Jr.

In U.S. Pat. No. 5,199,814, Clark et al. describe a short plastic post which is used for delineation of vehicle paths comprising facing truncated conical load bearing cells. One cell has its conical base secured to the ground and one cell has it conical base secured to an upstanding plastic post. The two cells truncated tips bear against each other with their axes normally aligned. The post extends upwardly from the conical base and contains a compression spring which tensions two cables which pass through the two cells. The tensioned cables pull the tips of the two cells to urge the post to remain vertically aligned. Like several of the other prior art designs, the heavy coil spring and related apparatus are located above the ground.

The Clark apparatus is a unitary assembly, providing the self-righting apparatus and post as one. The small conical cell tips are not conducive to supporting a large of tall signpost, or a retrofit post. The short post and apparatus are vulnerable to damage upon impact as the apparatus, spring and plastic post are above ground at the level of impact by the offending vehicle. Damage of the post requires replacement of substantially all of the apparatus. Further, the Clark apparatus is not amenable to retrofit of conventional metal road signposts.

Large numbers of metal signposts are in use by municipalities. The current preference of municipalities is to merely cut off and replace the existing metal posts, not substitute an all-new signposts. There is therefore a demonstrated need for a simple and robust self-righting apparatus which, most preferably is one which will adapt to the existing signposts typically in use.

SUMMARY OF THE INVENTION

Apparatus is provided for enabling a signpost to be self-righting after it has been tipped over and also return to its original orientation. The bulk of the apparatus is located in a cavity in ground and is not vulnerable to direct impact damage. In its preferred form, the apparatus is adapted to accept conventional signposts of any shaft profile.

Broadly, the apparatus comprises a plate for connecting to the shaft of the signpost and a complementary tray secured to the ground, the tray having upturned peripheral edges within which the plate rests. A tension member, like a cable or chain, is connected to the plate and extends through a hole in the tray and into a cavity formed under the tray, preferably the bore of a supporting pipe embedded in the ground. When the signpost tips, the plate rotates within the tray pulling the tension member. Beneath the tray, the tension member is connected to the bottom of a compression spring. The top of the spring bears against the tray so that when the tension member is pulled, it compresses the spring and increases the member's tension, urging the plate and signpost to right themselves. The plate and tray are polygonal in shape, preferably square, and are complementary so that the square sides engage during tipping and prevent rotation of the signpost's orientation when returning to the upright position.

Preferably the plate is fitted with a cup for insertion of a conventional signpost. Also, it is preferable to add a lip to the top of the plate for engaging and lifting the plate right up onto the tray's edge during rotation for increasing the tension member's displacement and increasing the springs compression.

BRIEF DESCRIPTION OF THE DRAWINGS

In FIG. 1*a*, the signpost is upright, representing the condition before or after an impact. In FIG. 1*b*, the signpost is shown tipped over during impact before it has righted itself back to the FIG. 1*a* position;

FIG. 3*a* illustrates the apparatus in the upright position, the pipe base mounted in concrete. FIG. 3*b* illustrates the apparatus in the tipped position, showing the compressed spring and the pipe base fitted to an in-ground sleeve.

DETAILED DESCRIPTION OF THE PREFERRED EMBODIMENT

Figures 1A, 1B:
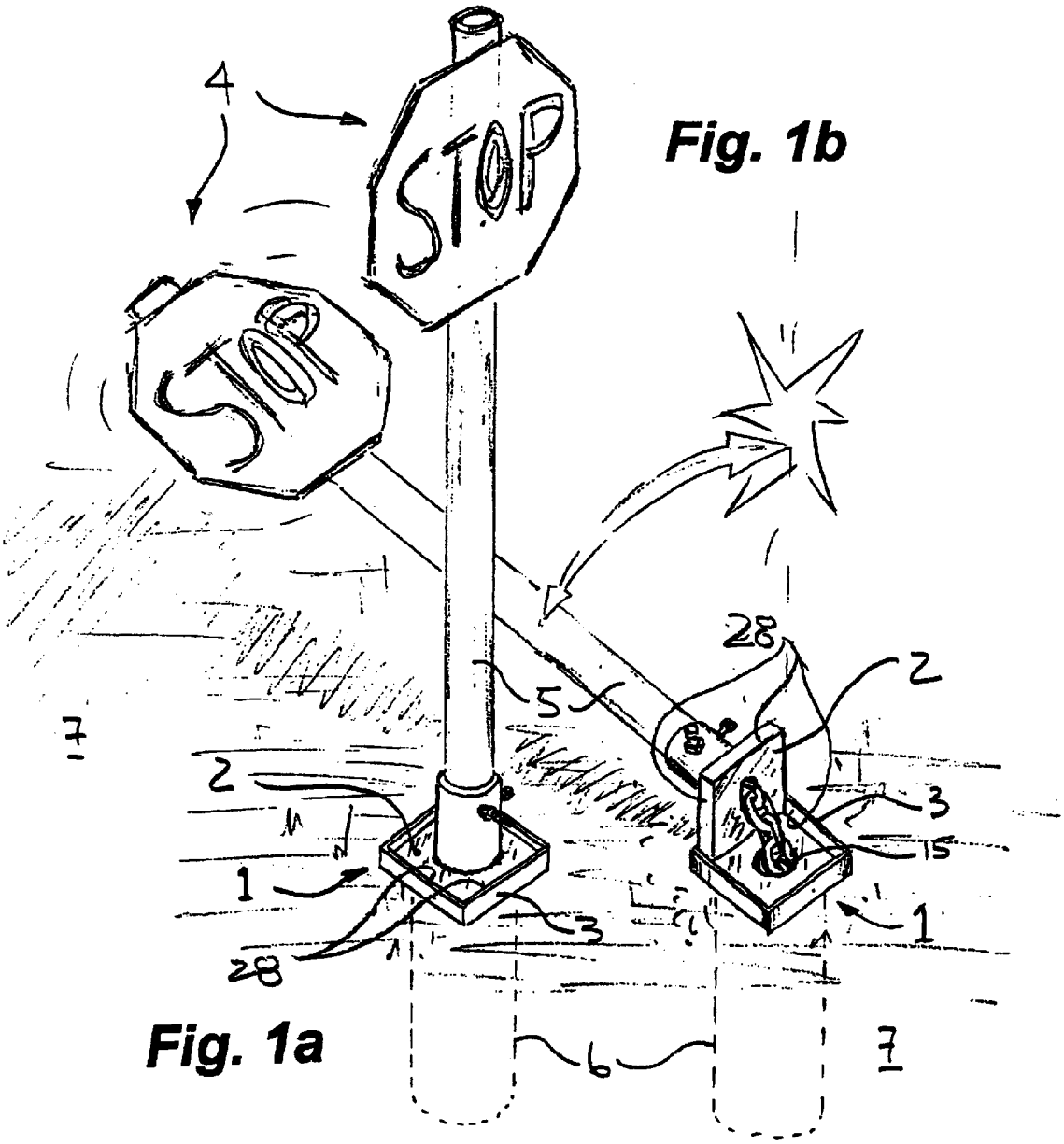
FIGS. 1*a* and 1*b* are perspective views of a conventional STOP signpost adapted to an embodiment of the present invention.
Figure 2:
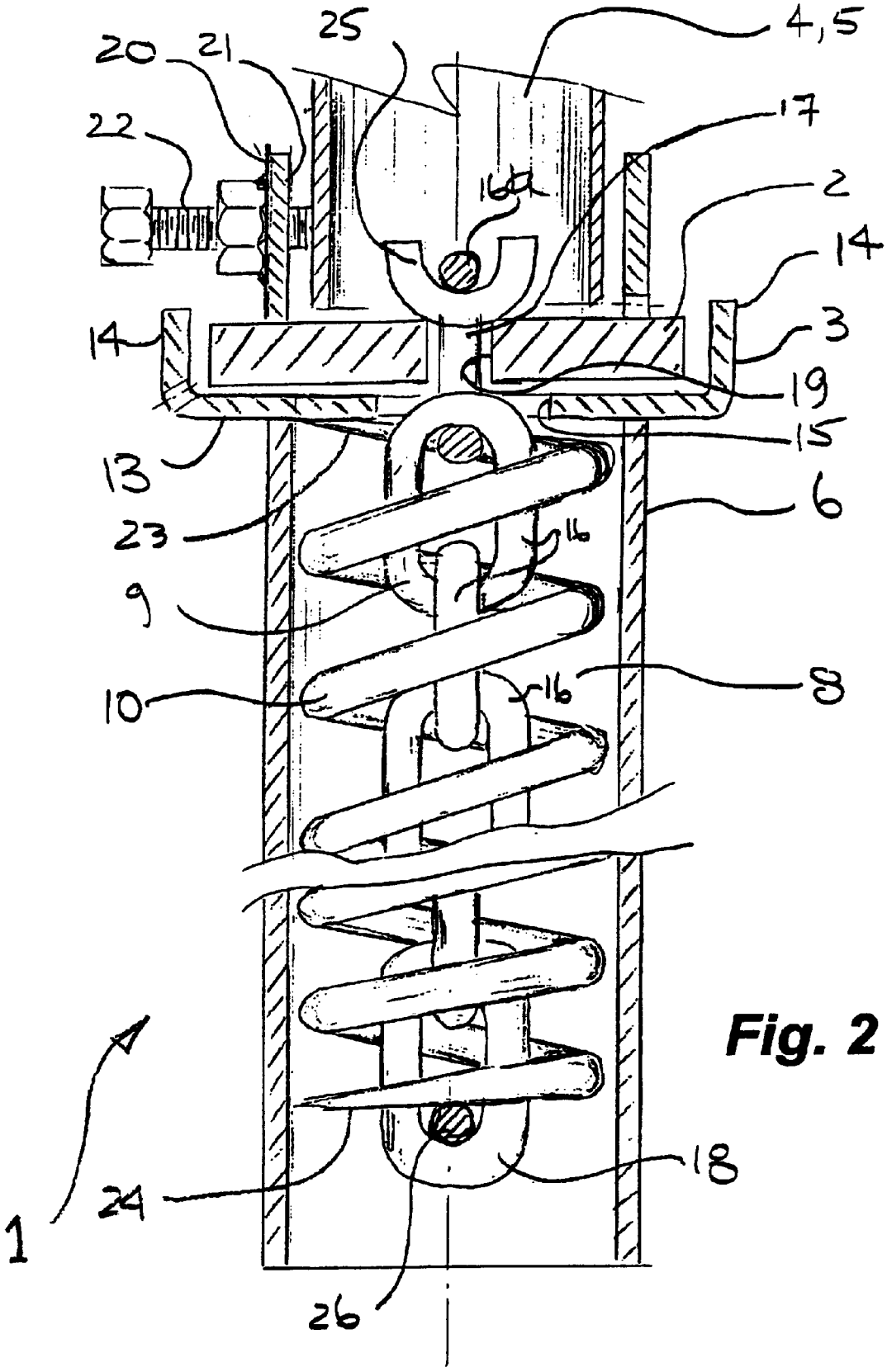
FIG. 2 is a cross-sectional view of one embodiment of the apparatus with the signpost in the upright position.

Having reference to FIGS. 1*a*, 1*b* and 2 a self-righting signpost apparatus 1 is provided comprising an adapter plate 2 movably fitted into a tray 3. A signpost 4 has a shaft 5, the bottom of which is mounted to the polygonal adapter plate 2. The tray 3 is secured atop a tubular member comprising a cylindrical pipe base 9 embedded in the ground 7. The pipe base 6 forms a cavity 8 therein. An elongate, flexible tension member 9 extends from the pipe base 6 and is secured to the adapter plate 2. A compression spring is located in the cavity 8 or bore of the pipe base 6 for imparting tension into the tension member. The tension member does not need to have rotational stiffness about its tensile axis.

Referring to FIGS. 1*a* and 1*b*, the adapter plate 2 and associated signpost have two operating positions in the extreme: first a tipped position (FIG. 1*b*) when the signpost 4 is forcibly tipped over; and a second position (FIG. 1*a*) where the signpost 4 is upright. The tension member 9 acts to right a tipped signpost 4 when the tipping force is removed.

Figures 3A, 3B:
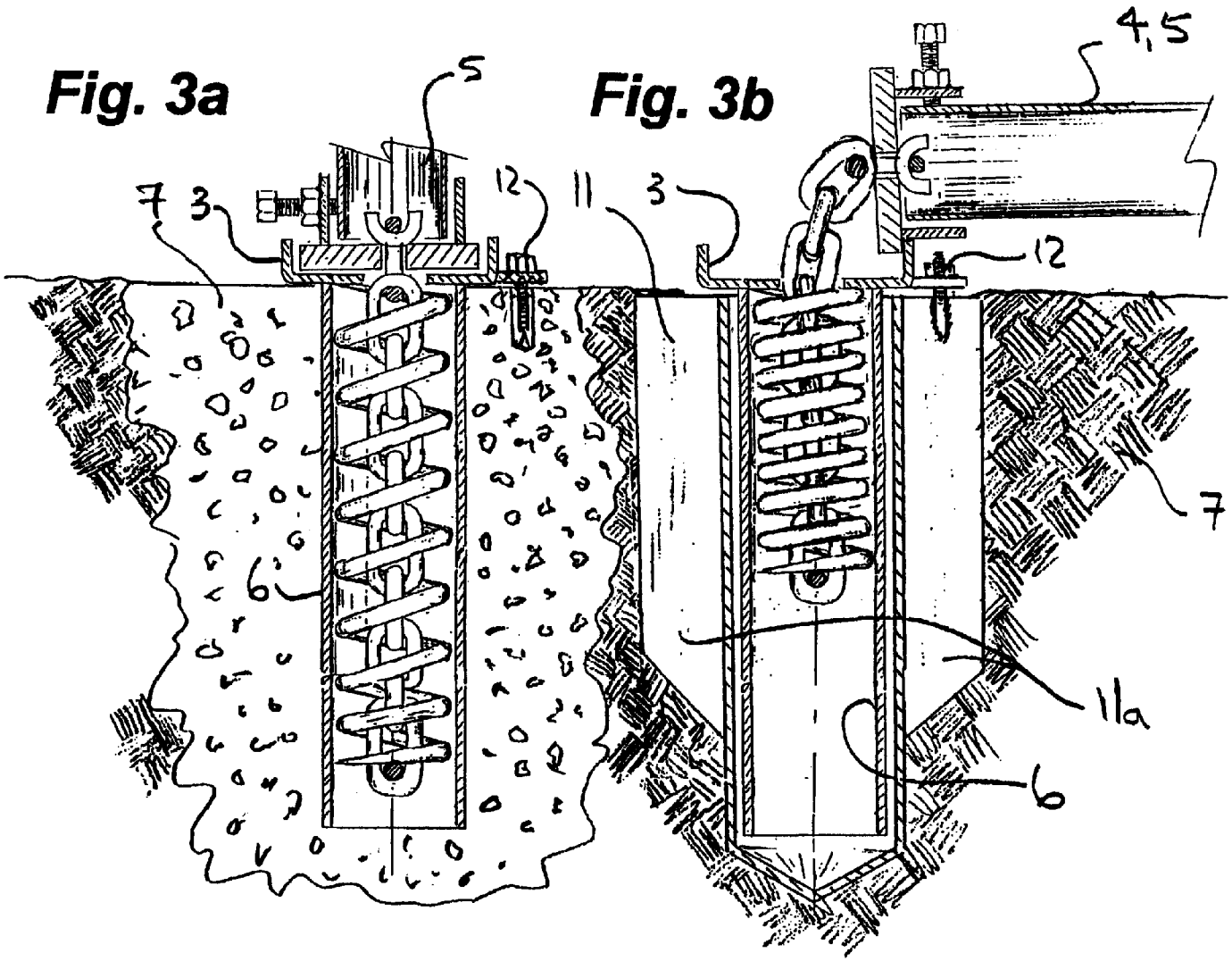
FIGS. 3*a* and 3*b* are cross-sectional views of the apparatus according to FIG. 2.

More particularly as shown in FIGS. 3*a*, 3*b*, the pipe base 6 is embedded directly in the ground or concrete 7 (FIG. 3*a*) or within a sleeve 11 embedded in same (FIG. 3*b*). The sleeve 11 has radial wings 11 a or other structure for providing additional support in soft ground 7 or for allowing easy removal of the pipe base 6. The apparatus 1 is shown anchored to the concrete 7 or secured to the sleeve 11 with a suitable anchor or fastener 12.

Turning to FIG. 2, the tray 3 is welded to the top of the pipe base 6 and comprises a polygonal plate 13 (square is shown) with upturned peripheral edges 14. A hole 15 is formed in the center of the tray 3 so that the tension member 9 can pass therethrough into the pipe base 6 positioned therebelow.

The preferred tension member is a chain 9 comprising a plurality of links 16. As the individual chain links 16 are alternating disposed at ninety degrees to one another, the tray hole 15 is circular and larger in diameter than the greatest dimension of the chain 9 so it can pass freely. The chain 9 has a top end 17 and a bottom end 18.

The adapter plate 2 is polygonal, the shape of which is complementary (square shown) to fit the polygonal tray 3. The adapter plate 2 has an oblong hole 19 formed through its center suitable to pass a single chain link 16.

The adapter plate 2 fits loosely within the upraised edges of the tray 3 and, in the upright position, the adapter plate 2 sits parallel with the tray's bottom plate 13. The thickness of the adapter plate 2 is less than the height of the tray's upturned edges 14. In the fully tipped position, the adapter plate 2 is roughly perpendicular to tray's plate 13.

A short cylindrical stub of pipe, or cup 20, is mounted to the adapter plate 2. The cup 20 has a bore 21 which is complementary to the cross section of the signpost's shaft 5. One or more retaining bolts 22 thread radially through the cup 20 to engage the signpost's shaft 5 and retain it therein.

The compression coiled spring 10 is fitted within the pipe base 6. The spring has a top end 23 and a bottom end 24. The uncompressed length (23,24) of the spring 10 is greater than the length (17,18) of the chain 9.

The link at the chain's top end 17 is passed through the oblong hole 19 and secured to the adapter plate 2 using a top retainer pin 25 formed of a cylindrical pin or half of a chain link 16. The chain's bottom end 18 is braced against the bottom of the spring 10 with a bottom retainer pin 26.

To assemble the apparatus 1, the bottom retainer pin 26 is fitted through the chain's bottom end 18. The spring 10 is installed in the cavity 8 of the pipe base 6. The chain's top end 17 is threaded upwardly through the bore of the coiled spring 10 towards the tray 3. The top 23 spring 10 bears against the tray 13. The bottom 24 of the spring 10 and bottom retainer pin 26 are compressed, compressing the spring 10 against the tray 3 until the chain's length 17,18 is greater than the compressed spring 23,24 (about 350 pounds compression). The excess length of chain 9 is fed through the hole 15 in the tray 3. The chain's top link 16*a* is inserted into the oblong slot 19 in the adapter plate 2. The top retainer 25 is inserted through the top link 16*a*, locking the chain 9 from returning to the pipe base 6.

Assembled, the compression spring 10 is locked in a compressive state, securely holding the adapter plate 2 against the tray 3. Preferably the top and bottom retainer pins 25,26 are welded to the chain 9 to prevent loss.

Referring to FIGS. 1*a*, 1*b*, 3*a*, and 3*b*, in operation, when the signpost 4 is impacted from the side (see FIG. 3*b* and represented by the star in FIG. 1*b*), the adapter plate 2 is forced laterally to engage the tray's upturned edges 14. The moment created by the lateral impact causes the signpost 4 and adapter plate 2 to pivot against the tray's upturned edge 14. As the adapter plate 2 rotates in the tray 3, the chain 9 is pulled up through hole 15. The chain 9 is laterally flexible and thus is not damaged as it turns to follow the adapter plate 2. As the chain 9 is displaced upwardly, the bottom retainer pin 26 further compresses the spring 10, creating an ever-increasing signpost uprighting force.

As shown in FIGS. 1*a* and 3*a*, the compressed spring 10 exerts sufficient force to right the signpost 4 back to the upright position. The complementary square side edges 28 of the polygonal plate 2 and tray 3 prevent undesirable rotation of the signpost about its axis thus ensuring that the signpost orientation is maintained as the chain 9 pulls the signpost 4 upright again. This is particularly important as in the case of warning signposts such as a STOP sign.

Figure 4B:
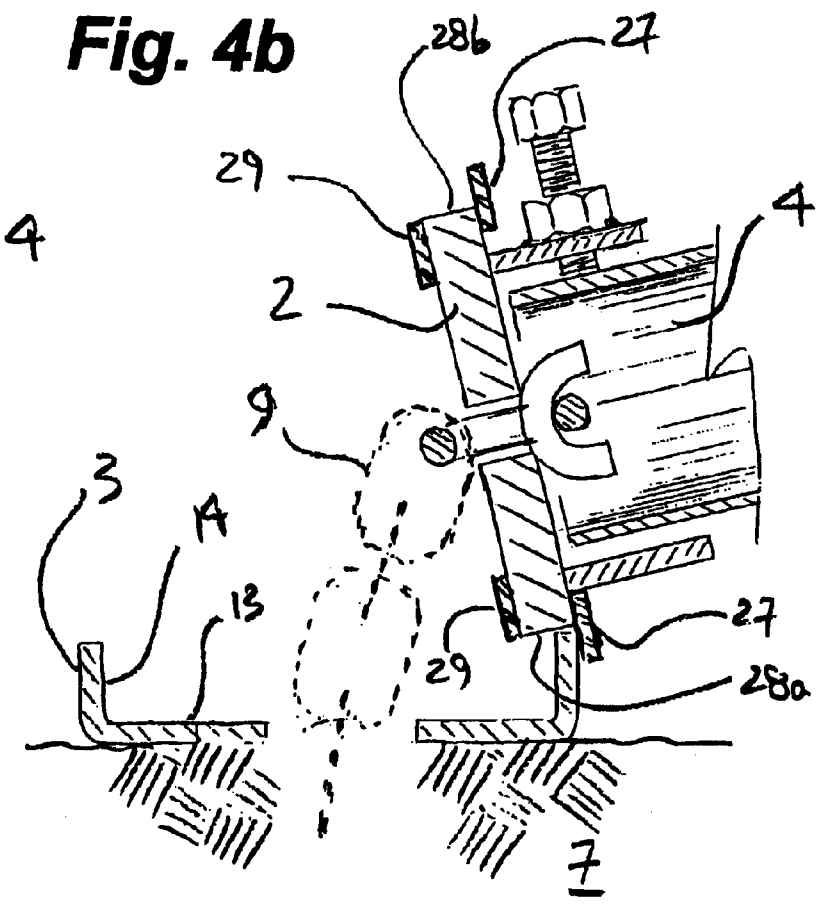
FIGS. 4*a* and 4*b* are cross-sectional views of the apparatus illustrating the first and second embodiments respectively.
Figure 4A:
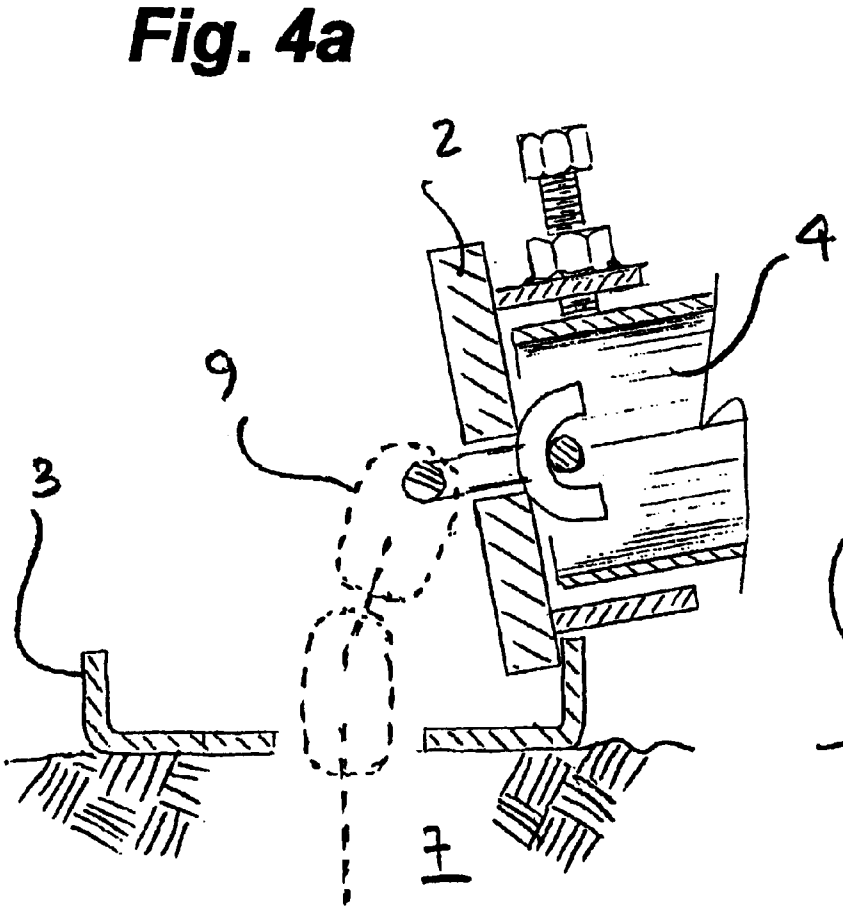

In a second embodiment, as shown in FIG. 4*b* and compared to the first embodiment shown in FIG. 4*a*, the signpost righting moment can be increased by increasing the distance the chain 9 is displaced for inducing greater compression in the spring 10. A lip 27 is mounted of the top of the adapter plate 2 on each of the polygonal sides 28 which will be subject to rotation. In FIG. 4*b*, lips 27 are provided on the two sides 28*a*,28*b* inline with normal vehicle motion. The lips 27 overhang the adapter plate 2 and when tipped the plate 2 engages and rides up onto the upturned edge 14, further displacing the chain 9 and further increasing the spring compression 10.

In a typical implementation, the apparatus 1 was constructed according to the first embodiment. The cup 20 was formed of a 3" tall, 2½" Sch. 40 pipe for accepting the shaft 5 of a standard 2" signpost. One or more ½" pinch bolts 22 are positioned about the cup 20 to engage the signpost's shaft 5. The cup 20 was welded to a 4" square and ½" thick steel adapter plate 2. The slot 19 in the adapter plate 2 was sized to fit a ⅜" chain link 16*a*. The tray 3 was fabricated of ¼" steel plate: a 4½" square bottom plate 13 for forming a 4½" inside dimension, with upturned edges 14 welded around the periphery of the bottom plate 13 for forming a ⅝" tall edge. The top of the adapter plate 2 was below the top of the tray edge 14. A 2" hole 15 was punched in the center of the tray's bottom plate 13. The tray 3 was centered and welded to the top of a 14" long by 2½" Sch. 40 pipe base 6. The chain 9 was a ⅜" steel link chain. The compression spring 10 was ⅜" spring steel having a 2¼" outside diameter with flat ends 23,24 for bearing against the tray 3 at its top 23 and for engaging the bottom retainer pin 26 at its bottom 24. The normally 12" long spring 10 was compressed by 2½" during installation. When tipped, the spring 10 was compressed a further 2½" producing about 500 pounds force. The top retainer pin 25 was conveniently formed of one half of a link 16. The bottom retainer pin 26 was formed of a ½" cylindrical pin of about 2¼" long. The above implementation has withstood impacts at vehicle speeds in excess of 40 mph without separation of the apparatus 1 from the ground or failure.

In another implementation, apparatus 1 was constructed according to the second embodiment. The same spring 10 was used as in the first implementation. A 5" plate 2 was fitted with a lip 27 having about a ⅜" overhang. A tray 3 was provided with a 5" inside dimension and ⅝" upturned edges. The ½ thick plate 2 was fitted with small 3/16" elevating feet 29 to raise the plate 2 and the underside of the lip 27 to the same elevation as the top of the upturned edge 14. Accordingly, when tipped, the lip 27 raised the plate 2 up onto the edge 14, increasing the spring compression by about a further ½".

Preferably an inclined ramp (not shown) is placed on the traffic side of the apparatus to direct the undercarriage of a vehicle or other damaging structure above and over the upturned adapter plate. The ramp extends from a leading edge adjacent the ground and ramps upwardly. The ramp continues upward and extends for the entire depth of the tray, the height of the ramp at its end exceeds the height of the adapter plate 2 when rotated in the tipped position. The ramp is secured, as be welding to the tray. The ramp's leading edge is anchored to the ground or concrete.

In one implementation of a ramp, a 12" long, 5" wide by 2" deep flange steel channel was employed as a ramp. The flanges at the ramp's leading edge were tapered to conform to the ground. The ramp was welded at its midpoint to the tray. For the implementation described above, the ramp's end had a height in excess of 4" for protecting the 4" adapter plate.

The embodiments of the invention in which an exclusive property or privilege is claimed are defined as follows:

1. Apparatus for automatically righting a signpost which had been subjected to a temporary tipping moment comprising:

a polygonal tray having a top and a bottom, the tray being positioned over a cavity in the ground and having a hole through the tray's center for providing access to the cavity, the top of the tray having upturned peripheral edges;

means for securing the tray to the ground;

a compression spring located in the cavity below the tray, said spring having top and bottom ends, the top end bearing against the bottom of the tray;

a polygonal plate sized to fit within the tray's peripheral edges, the plate having sides complementary to the polygonal shape of the tray;

adaptive means for connecting the signpost to the plate;

an elongate, laterally flexible tension member extending from the plate, through the tray's hole and bearing against the bottom end of the spring so that in a first position, the polygonal plate is forcibly restrained within the tray to hold the signpost upright, and in a second position, when a moment is applied to the signpost, a polygonal side of the plate engages the complementary polygonal upturned edge of the tray causing the plate to rotate, displacing a portion of the tension member through the hole and compressing the spring, the compressed spring urging the signpost to right itself again to the first position, the complementary polygonal shape of the tray and plate acting to prevent axial rotation of the signpost and thereby ensure consistent signpost orientation.

2. Apparatus as recited in claim 1 wherein the means for securing the tray to the ground comprises;

a tubular member embedded in the ground and mounted to the bottom of the tray, the tubular member having a bore which forms the cavity and which communicates with the hole in the tray.

3. Apparatus as recited in claim 2 wherein the polygonal tray and plate are square.

4. Apparatus as recited in claim 3 wherein the tension member is a length of chain.

5. Apparatus as recited in claim 2 wherein the tubular member is inserted concentrically into a sleeve embedded in the ground and removably secured therein, the sleeve having structure for improved support in the ground.

6. Apparatus as recited in claim 4 wherein the signpost has a shaft and the adaptive means for connecting to the signpost comprises:

a tubular cup mounted to the plate, the cup having a bore which is complementary to the signpost's shaft so that the shaft fits into the cup's bore; and means for securing the shaft to the cup.

7. Apparatus as recited in claim 6 wherein the plate is formed with a lip on at least one polygonal side so that when the plate rotates in the tray, the lip lifts the plate up onto the upturned edge of the tray, further increasing the displacement of the tension member for increasing the compression of the spring and improving the signpost's ability to self-right itself.

* * * * *